US005537178A

United States Patent [19]

Van Den Bergen et al.

[11] Patent Number: 5,537,178

[45] Date of Patent: Jul. 16, 1996

[54] APPARATUS FOR THE PROCESSING OF PHOTOGRAPHIC SHEET MATERIAL

[75] Inventors: Patrick Van Den Bergen, Berchem; William Fobelets, Lennik; Bart Verlinden, Tongeren, all of Belgium

[73] Assignee: Aofa-Gevaert N.V., Mortsel, Belgium

[21] Appl. No.: 384,768

[22] Filed: Feb. 7, 1995

[51] Int. Cl.[6] ..... G03D 7/00

[52] U.S. Cl. ..... 354/300; 34/362; 34/637; 354/337

[58] Field of Search ..... 354/297, 300, 354/324, 337; 34/615, 244, 362, 637

[56] References Cited

U.S. PATENT DOCUMENTS

| | | | |
|---|---|---|---|
| 2,994,134 | 8/1961 | Adams . | |
| 3,158,447 | 11/1964 | Sable | 34/151 X |
| 3,192,846 | 7/1965 | Wright | 354/324 |
| 3,203,106 | 8/1965 | Oderman | 34/150 |
| 3,481,046 | 12/1969 | Kuroki et al. | 34/156 |
| 3,769,897 | 11/1973 | Zwettler et al. | 354/322 |
| 3,771,235 | 11/1973 | Minoda et al. | 34/362 |
| 3,856,555 | 12/1974 | Mandeville | 354/297 |
| 5,077,570 | 12/1991 | Schell | 354/354 |

*Primary Examiner*—D. Rutledge

*Attorney, Agent, or Firm*—Brumbaugh, Graves, Donohue & Raymond

[57] ABSTRACT

A processing apparatus comprises at least one wet processing station followed by a dryer in which wet sheet material comes into contact with heated drying air. Sheet material is fed over a static support member which supports the sheet material during drying. A drying unit is positioned opposite to and extending across the support member in a transverse direction, thereby to define a drying space between the support member and the drying unit. Drying air is fed to the drying unit to pass out through a drying air exit into the drying space. The support member includes a plurality of openings to allow drying air to pass therethrough, to ensure that the air flow is substantially the same whether a sheet of photographic material is positioned on the support member or not, while minimising the generation of turbulence.

18 Claims, 5 Drawing Sheets

APPARATUS FOR THE PROCESSING OF PHOTOGRAPHIC SHEET MATERIAL

FIELD OF THE INVENTION

The present invention relates to an apparatus for the processing of photographic sheet material, in particular film or other photo-chemical material, particularly for developing exposed photographic material. In such a process the sheet material is brought into contact with aqueous processing liquids in a processing machine which comprises at least one wet processing station followed by a dryer in which wet sheet material comes into contact with heated drying air.

BACKGROUND OF THE INVENTION

A known apparatus, as described in European patent applications EP 93202862.4, 93202901.0 and 94202533.9 (Agfa-Gevaert NV), for the processing of photographic sheet material comprises at least one wet processing station followed by a dryer in which wet sheet material comes into contact with heated drying air. The dryer comprises a drying unit positioned opposite to and extending across a support member in a direction transverse to the transport direction, thereby to define a drying space between the support member and the drying unit. Sheet material is fed in a transport direction over the support member.

The material to be dried in such an apparatus usually consists of cut sheets of variable dimensions. Drying air from the drying unit is therefore sometimes directed towards a sheet to be dried but at other times towards parts of the support member on which no sheet is supported. Drying air directed towards the support member is deflected to pass across the drying space, in a plane approximately parallel to the support surface of the support member. At the edges of any sheet material present in the drying space, this deflected drying air causes turbulence. Such turbulence results in unstable transport of the sheet material and may even cause damage to the emulsion when the leading or trailing edge is moving freely over the support surface.

SUMMARY OF THE INVENTION

It is an object of the present invention to provide an apparatus for the processing of photographic sheet material in which the aforementioned disadvantages can be substantially overcome.

We have discovered that this objective is achieved by a particular construction of the support member, and/or control of the heated drying air flow.

Thus according to a first aspect of the invention there is provided an apparatus for the processing of photographic sheet material, the apparatus comprising at least one wet processing station followed by a dryer in which wet sheet material comes into contact with heated drying air, the dryer comprising:

(i) a static support member for supporting the sheet material during the drying thereof;

(ii) feed means for feeding sheet: material in a transport direction over the static: support member;

(iii) a drying unit positioned opposite to and extending across said static support member in a direction transverse to the transport direction, thereby to define a drying space between the static support member and the drying unit, the drying unit having a drying air exit above the support member; and (iv) means for feeding drying air to the drying unit to pass out through the drying air exit into the drying space, wherein the static support member includes a plurality of openings to allow drying air to pass therethrough.

According to a second aspect of the invention, there is provided a method for the drying of wet photographic sheet material, following at least one wet processing station, by use of a dryer comprising:

(i) a static support member for supporting the sheet material during the drying thereof, said static support member including a plurality of openings to allow drying air to pass therethrough;

(ii) feed means for feeding sheet material in a transport direction over said static support member; and (iii) a drying unit positioned opposite to and extending across said static support member in a direction transverse to said transport direction, thereby to define a drying space between said static support member and said drying unit, said drying unit having a drying air exit above the static support member, wherein said method includes feeding heated drying air to said drying unit to pass out through said drying air exit into said drying space to contact said sheet material, the heated drying air flow through said drying air exit being substantially independent of the size of said sheet material.

The provision of openings in the support member ensures that, in advance of the leading edge and beyond the trailing edge of the sheet material, the flow of air from the drying air exit passes through the openings in the support member, rather than being deflected by the support member giving rise to turbulence at the edges of the sheet material, while minimising the generation of turbulence created by the incoming drying air which would arise if the support member had no such openings.

The openings in the support member may be in the form of slots, especially a plurality of uniformly distributed, equally sized and spaced slots. In particular, the slots may be arranged in a plurality of rows extending transverse to the transport direction or at a small angle such as from 1° to 10° to the transport direction. The openings are preferably distributed over the support member in such a manner that the air velocity distribution remains substantially constant over the support member.

The openings in the support member preferably occupy from 20% to 40%, most preferably from 25% to 30% of the area of that surface thereof which faces the drying unit. Below 20%, insufficient reduction in turbulence may be achieved, while it is difficult to construct a support member of sufficient mechanical strength where the openings occupy more than 40% of the surface. If too high a proportion of openings is employed, the drying air may preferentially pass outside the limits of the sheet material. The provision of the openings in the support member ensures that the air flow through the blower slots is substantially the same whether a sheet of photographic material is positioned on the support member or not, irrespective of the size of the sheet material.

The support member may have a corrugated form defined by a plurality of hollows interspaced with a plurality of ridges, the hollows and ridges extending in a direction transverse to the transport direction, preferably with the openings being formed in the hollows, the openings preferably not being positioned directly opposite to the drying air exit. This corrugated form has the advantage that contact between the photographic sheet material and the support member is minimised. Support means, such as a plurality of support wires, bars or strips extending generally in a direction parallel to the transport direction, or at a small angle such as from 5° to 20° thereto may be provided to prevent sheet material from falling into the hollows.

Preferably, the heated drying air passes through the drying air exit to contact the sheet material at an angle substantially normal thereto. In a preferred embodiment, the drying air exit of the drying unit is in the form of a blower slot, the drying unit further having a return slot positioned adjacent the blower slot through which used drying air is able to leave the drying space. Ideally, the drying unit comprises a plurality of the blower slots, with return slots positioned therebetween. The return slots, preferably positioned one on either side of each blower slot, also avoid the used air being evacuated to the upstream and downstream sides, and to the left and right sides of the dryer, resulting in a loss of drying capacity.

Each blower slot may be defined by upstream and downstream walls, the upstream walls preferably being positioned closer to the support member than the downstream walls. This construction has the advantage that the sheet cannot enter a blower slot, even if the sheet were to become curled.

The sheet feed means may comprise a first pair of transport rollers positioned upstream of the support member and a second pair of transport rollers positioned downstream of the support member.

In a preferred embodiment of the invention, a processing apparatus according to the invention includes upstream and downstream drying units. A heater heats air entering the downstream unit to a downstream drying temperature. A fan recirculates drying air from the downstream unit through the heater while taking in fresh air through a fresh air inlet. Another heater heats air entering the upstream unit to a temperature higher than the downstream drying temperature. A fan recirculates air from the upstream unit through the heater while taking in air from the downstream unit.

In an embodiment of the present invention, the drying air exit is fed with drying air from a manifold, the manifold being connected at a first side of the dryer to a heater provided for heating air entering the manifold and the manifold has a tapered configuration, narrowing in the direction away from the first side. This tapered construction helps to ensure that the flow of drying air out of the manifold, through the blower slots, is substantially uniform over the width of the support member. Used drying air returns to the fan either through the openings in the support member, over the left hand edge of the support member or over the right hand edge of the support member. This uneven return of used drying air has the effect that the air flow distribution across the width of the support member is not uniform, and may even be negative towards one side of the support member with the result that cold air is drawn into the dryer at this side resulting in uneven drying of the photographic material.

Ideally, the heated drying air is so directed that substantially no external air is drawn into the drying space during drying of the sheet material. In order to achieve this, in a more preferred embodiment, a baffle plate is positioned below the support member and parallel thereto, the baffle plate ensuring that used drying air returns to the fan from the opposite side of the dryer, thereby cutting off a "short circuit" path for the used drying air. This arrangement serves to ensure that the flow of drying air out of the manifold, through the blower slots is even more uniform over the width of the support member. This more even return of used drying air has the effect that the air flow distribution across the width of the support member is more uniform, with the result that no cold air is drawn into the dryer at this side resulting in more even drying of the photographic material.

The avoidance of cold air being drawn into the dryer can be achieved by an over-pressure of the heated drying air, but this tends to result in heated drying air escaping from the dryer into room, which may be inconvenient for the occupants of the room and is wasteful of heating energy.

BRIEF DESCRIPTION OF THE DRAWINGS

The invention will now be further described, purely by way of example, by reference to the accompanying drawings in which.

PREFERRED EMBODIMENT OF THE INVENTION

Figure 1:
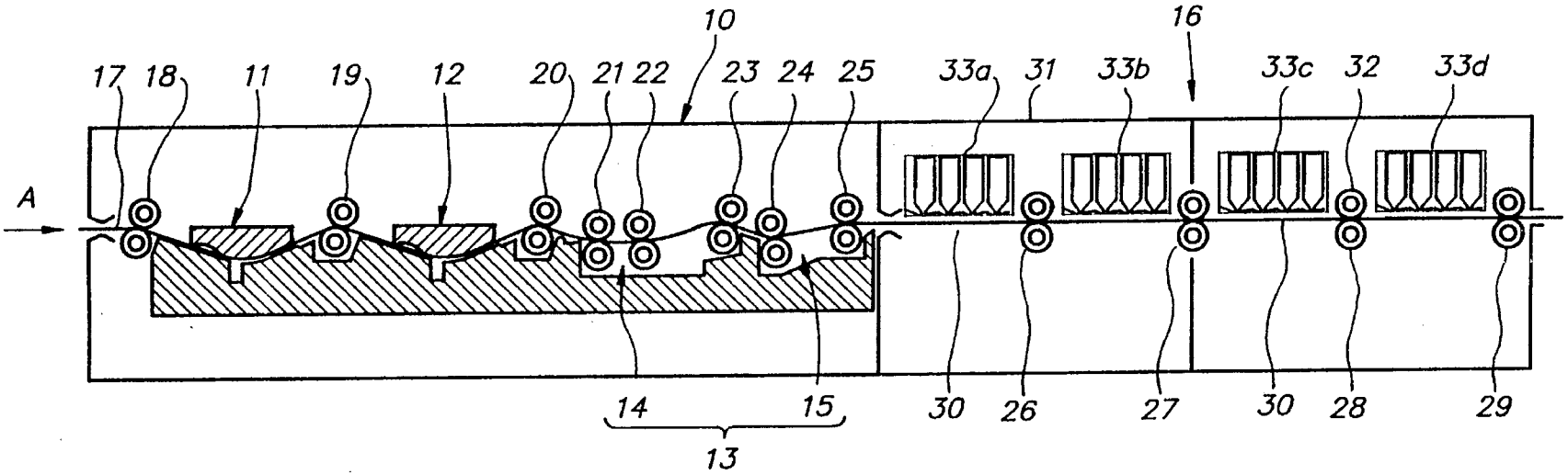
FIG. 1 is a diagrammatic longitudinal section of one embodiment of a processor for colour proof material.

With reference to FIG. 1, there is illustrated a longitudinal section through an apparatus 10 for processing exposed photographic sheet material, in particular photographic film for colour proofing, such as AGFAPROOF materials, marketed by Agfa-Gevaert NV. The processor 10 comprises a developing station 11, a bleach-fixing station 12, a washing station 13 with a washing section 14 and a rinsing section 15, and a dryer 16.

A sheet of photographic sheet material 17 is transported at uniform velocity through the processor by means of suitably driven pressure roller pairs 18, 19, 20, 21, 22, 23, 24 and 25, the roller pairs for the dryer being indicated in FIG. 1 as 26, 27, 28 and 29. Each roller pair is mounted between two lateral walls (not shown) spaced in parallel relationship.

The dryer 16 is subdivided into an upstream drying chamber 31 and a downstream drying chamber 32. Drying chamber 31 includes two parallel dryer units in the form of cassettes 33*a* and 33*b*. Similarly, drying chamber 32 includes two dryer cassettes 33*c* and 33*d*. Each dryer cassette comprises four blower slots 30 located above the sheet material path.

Figure 2:
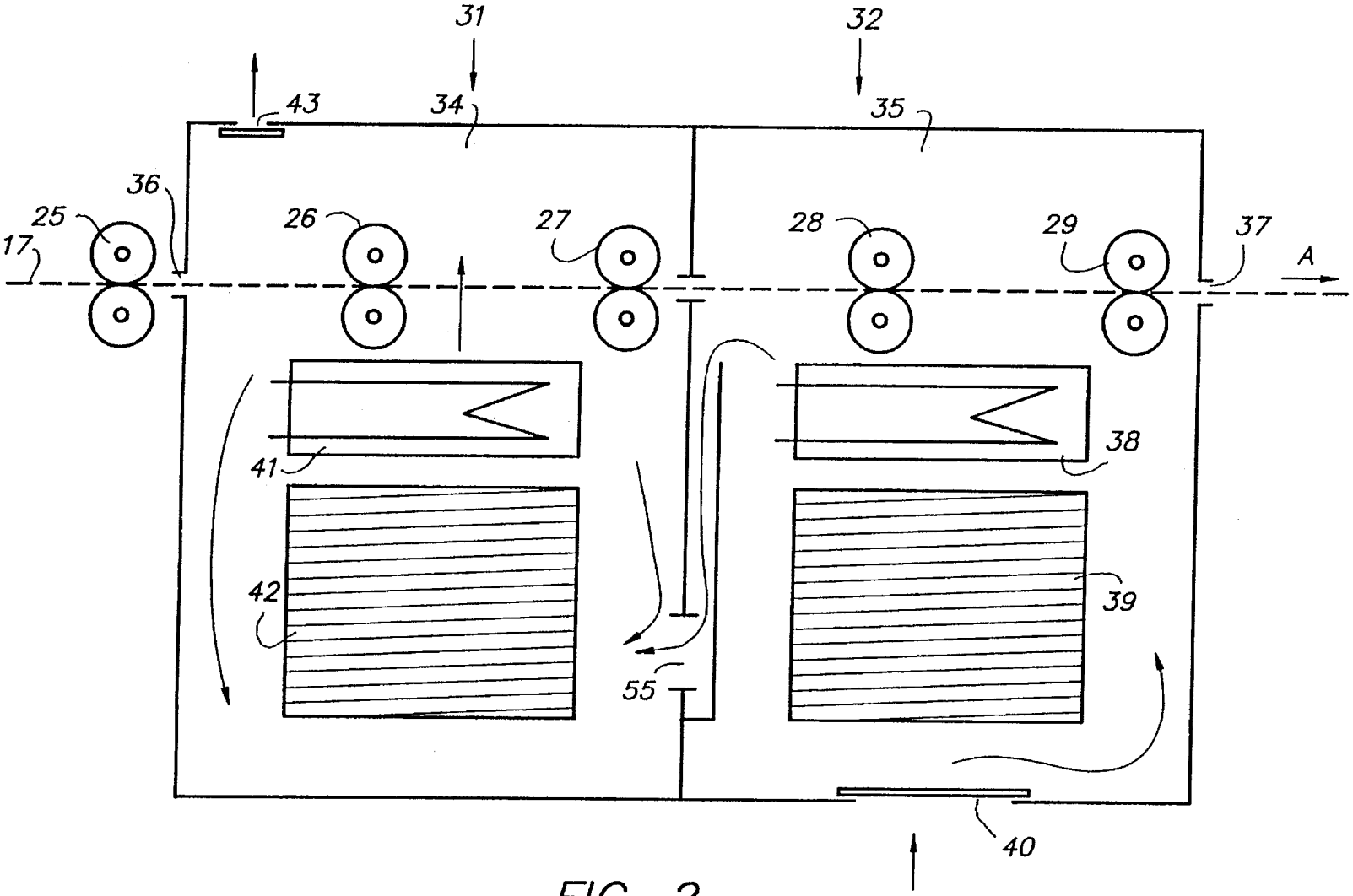
FIG. 2 is a schematic longitudinal cross-sectional view of the dryer of the apparatus shown in FIG. 1.

Referring to FIG. 2, there is shown the means for supplying drying air to the drying chambers 31, 32, positioned to one side of the apparatus. The drying cassettes 33*a* and 33*b* of the upstream drying chamber 31 are connected in parallel to an upstream manifold 34, while the drying cassettes 33*c* and 33*d* of the downstream drying chamber 32 are connected inn parallel to a downstream manifold 35. The wet sheet material 17 is fed into the dryer through a sheet material feed opening 36 and leaves by way of a sheet material exit opening 37.

The-sheet material passes through the drying chambers at a linear speed of about 0.8 m/minute.

A downstream heater 38 is provided for heating air entering the downstream manifold 35 to a downstream drying temperature of about 55° C., which depending on the moisture level of the wet sheet material 17 as it enters the downstream drying chamber 32 is equivalent to a wet bulb temperature of below 40° C. A downstream fan 39 recirculates a major proportion of drying air amounting to about 70% to 80%, preferably about 75% thereof from the drying cassettes of the downstream drying chamber 32 through the downstream heater 38 while taking in a minor proportion of fresh air through a fresh air inlet 40.

An upstream heater 41 heats air entering the upstream drying chamber 31 to an upstream drying temperature of about 60° C., that is higher than the downstream drying temperature. The upstream drying temperature, depending on the moisture level of the wet sheet material 17 as it enters the upstream drying chamber 31, is equivalent to a wet bulb temperature of below 40° C. The absolute humidity in the upstream drying chamber 31 will be higher than in the downstream drying chamber 32 since the wet photographic sheet material 17 passes first through the upstream drying chamber 31.

An upstream fan 42 recirculates a major proportion of drying air amounting to about 75% thereof from the dryer cassettes of the upstream drying chamber 31 through the upstream heater 41 while taking in a minor proportion of air from the downstream drying chamber 32 via a passage 55. Air leaves the upstream drying chamber 31 through an exhaust outlet 43.

The heated air which is passed into the downstream drying chamber 32 consists partly of outside air and partly of air which has been recirculated from the downstream drying chamber 32. It is important to ensure that cold outside air does not enter the upstream and downstream drying chambers with the photographic sheet material. This is ensured in that the air pressure inside the drying chambers 31, 32 is higher than the ambient air pressure. Since the absolute humidity is lower in the downstream drying chamber 32 than in the upstream drying chamber 31, the drying air is heated by the upstream heater 41 to reach approximately a comparable relative humidity. The recirculation of heated drying air reduces energy consumption, while the intake of a proportion of outside fresh air enables a lower relative humidity to be achieved.

Figure 3A:
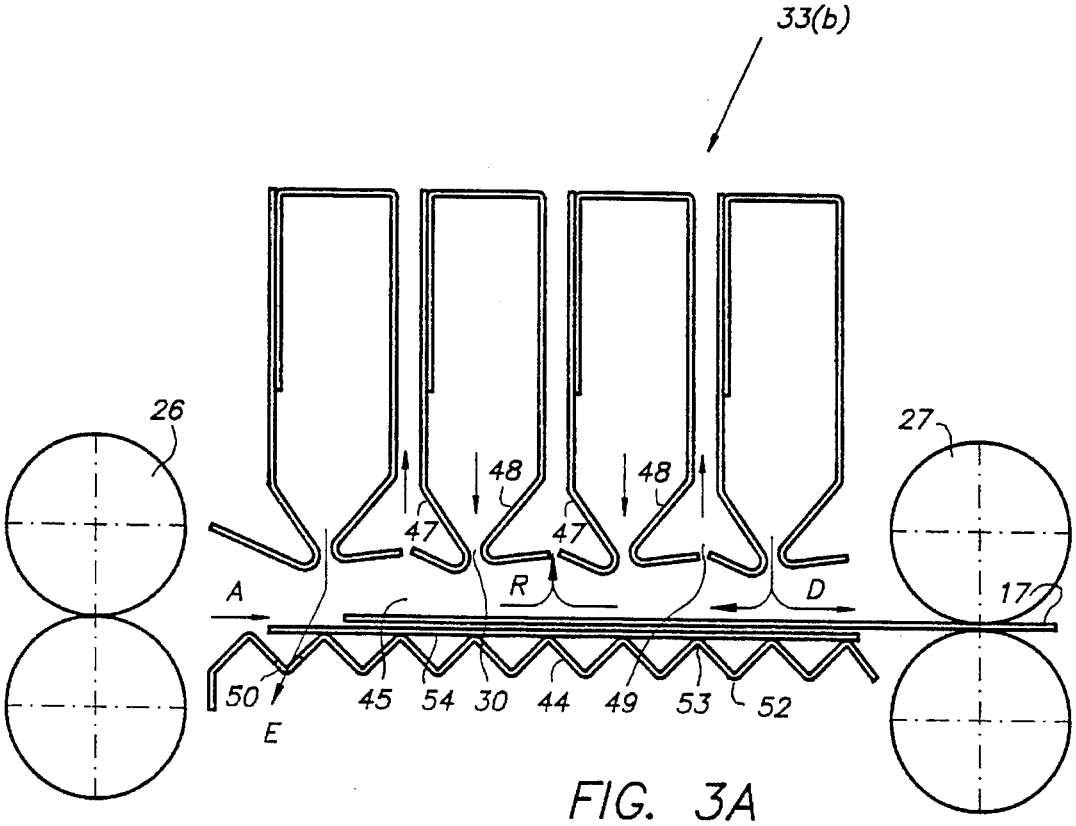
FIG. 3A is a longitudinal section through a dryer cassette of the apparatus shown in FIGS. 1 and 2.

Referring to FIG. 3A, which shows the second dryer cassette 33*b* of the upstream drying chamber 31 (the other dryer cassettes 33*a*, 33*c* and 33*d* are similar), it can be seen that the dryer cassette is positioned above a static support member 44 for supporting the sheet material 17 during drying. The support member 44 may be stainless steel or alternatively be formed of a reinforced moulded plastics material. A first pair of transport rollers 26 positioned upstream of the support member 44 and a second pair of transport rollers 27 positioned downstream of the support member 44 feed the sheet material 17 in a transport direction A over the support member 44. The dryer cassette 33*b* extends across the support member 44 in a direction B transverse to the transport direction A. A drying space 45 is thereby defined between the support member 44 and the dryer cassette 33*b*. The dryer cassette 33*b* has an assembly of four blower slots 30, each having an opening width of between 1.4 and 2.0 mm, preferably about 1.7 mm to ensure a drying air speed within the range of 6 to 9 m/sec. Above or below this optimum slot width, the air speed drops significantly. Upstream fan 42 feeds drying air to the dryer cassette 33*b* to pass out through the blower slots 30 into the drying space 45 across the full width of the support member, to strike the sheet material 17 at an angle normal thereto, as shown by the arrows D in FIG. 3A.

Each blower slot 30 is defined by upstream and downstream walls 47, 48. The upstream walls 47 are positioned closer to the support member 44 than the downstream walls 48. The spaces between each downstream wall and the respective next upstream wall define a number of return slots 49 positioned adjacent each blower slots 30 through which used drying air is able to leave the drying space 45, as shown by the arrows R in FIG. 3A. The return slots 49 avoid the used air being evacuated to the left and right sides of the dryer, resulting in a loss of drying capacity.

Figure 3B:
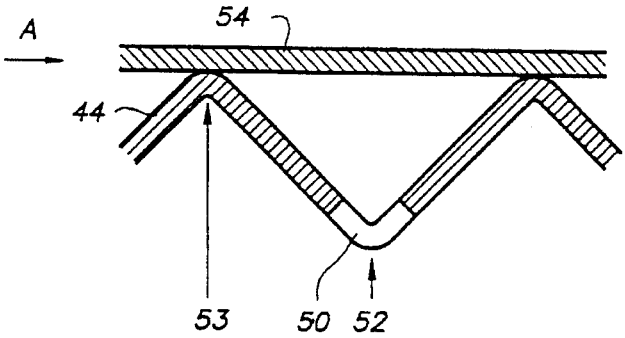
FIG. 3B is an enlargement of part of one static support member used in the apparatus shown in FIGS. 1, 2 and 3A.
Figure 4A:
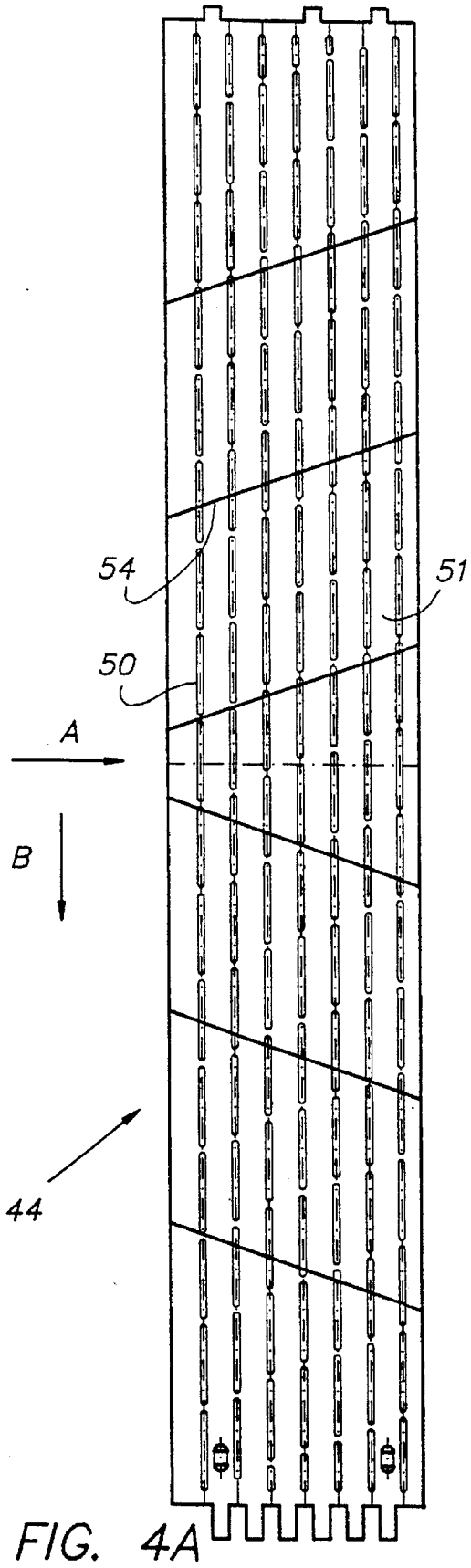
FIG. 4A is a view taken from above of one static support member used in the apparatus shown in FIGS. 1, 2 and 3.

Referring additionally to FIGS. 3B and 4A, it can be seen that the support member 44 includes a large number of equally spaced slots 50 to allow drying air to pass therethrough. The slots 50 are arranged in a plurality of rows extending in the transverse direction B. The slots 50 are uniformly distributed over the support member 44. The support member has a surface 51 facing the drying chambers 31, 32, the slots 50 occupying about 27% of the area of the support member surface 51, measured in the transport plane.

The support member 44 has a corrugated form defined by a plurality of hollows 52 interspaced with a plurality of ridges 53. The hollows 52 and ridges 53 extend in the transverse direction B, with the slots 50 formed in the hollows 52, although in an alternative embodiment it is possible for these ridges to extend at a small angle to the transverse direction B. A plurality of support wires 54 prevent sheet material 17 from falling into the hollows 52. The wires 54 extend generally in a direction parallel to the transport direction A, but ideally are at a slight divergent angle thereto, such as between 5° and 20° to the transport direction A, to avoid the formation of hot spots on the film material which might lead to systematic marks on the dried sheet material.

As can be seen from FIG. 3A, the blower slots 30 are positioned opposite to ridges 53 in the support member 44. Beyond the trailing edge of the sheet material 17 the flow of air from the blower slots 30 in the cassette 33 passes through the holes 50 in the support member 44 as indicated by the arrow E, rather than being deflected by the support member giving rise to turbulence at the trailing edge of the sheet material, while minimising the generation of turbulence created by the incoming drying air which would arise if the support member had no such openings. A similar benefit is achieved with respect to the leading edge of the next following sheet, and also with respect to the side, edges of the sheets.

Figure 3C:
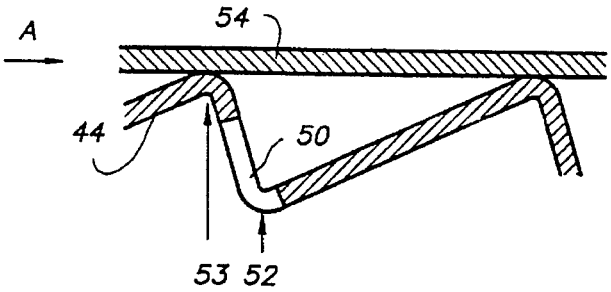
FIG. 3C is a view, similar to FIG. 3B, of an alternative embodiment of the present invention.
Figure 4B:
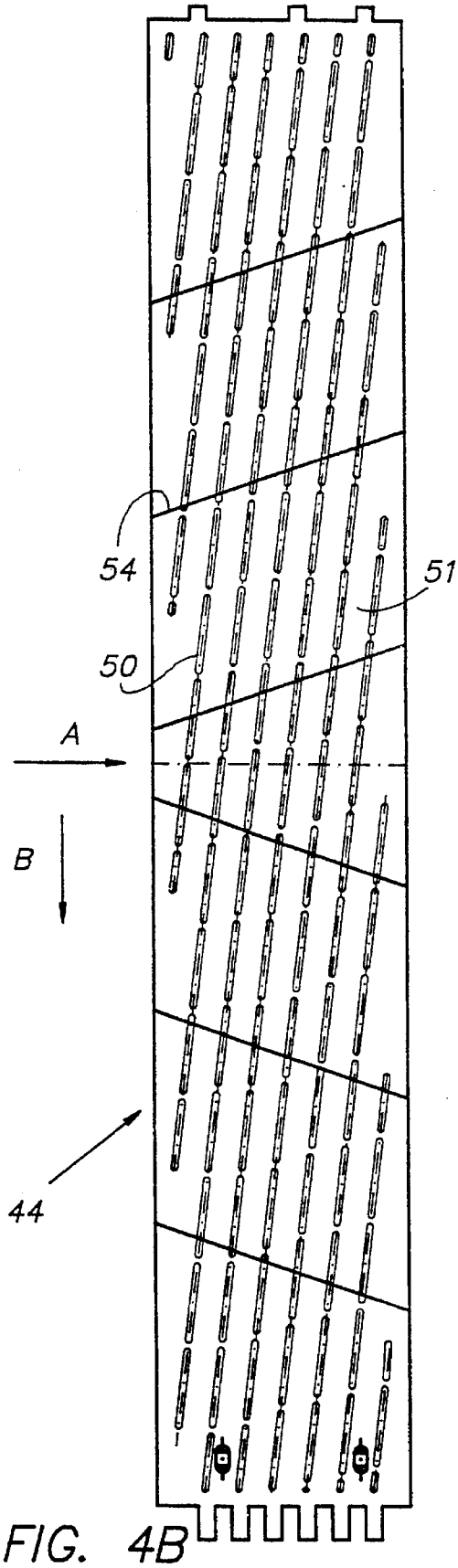
FIG. 4B is a view taken from above of an alternative static support member suitable for use in the apparatus shown in FIGS. 1, 2 and 3.

In the embodiment shown in enlarged section in FIG. 3B, the cross-sectional profile of the support member 44 is symmetrical, the slots 50 being formed in the hollows 52. In the embodiment shown in enlarged section in FIG. 3C, the cross-sectional profile of the support member 44 is non-symmetrical, having a sawtooth-like configuration, the slots 50 being formed somewhat upstream of the hollows 52. This feature further reduces the risk of a leading edge of the sheet material being caught up by the edges of the slots 50. The embodiment of the support member 44 shown in FIG. 4B is similar to that shown in FIG. 4A except that the slots 50 are arranged in a plurality of rows extending at an angle of about 7° to the transverse direction B.

Figure 5:
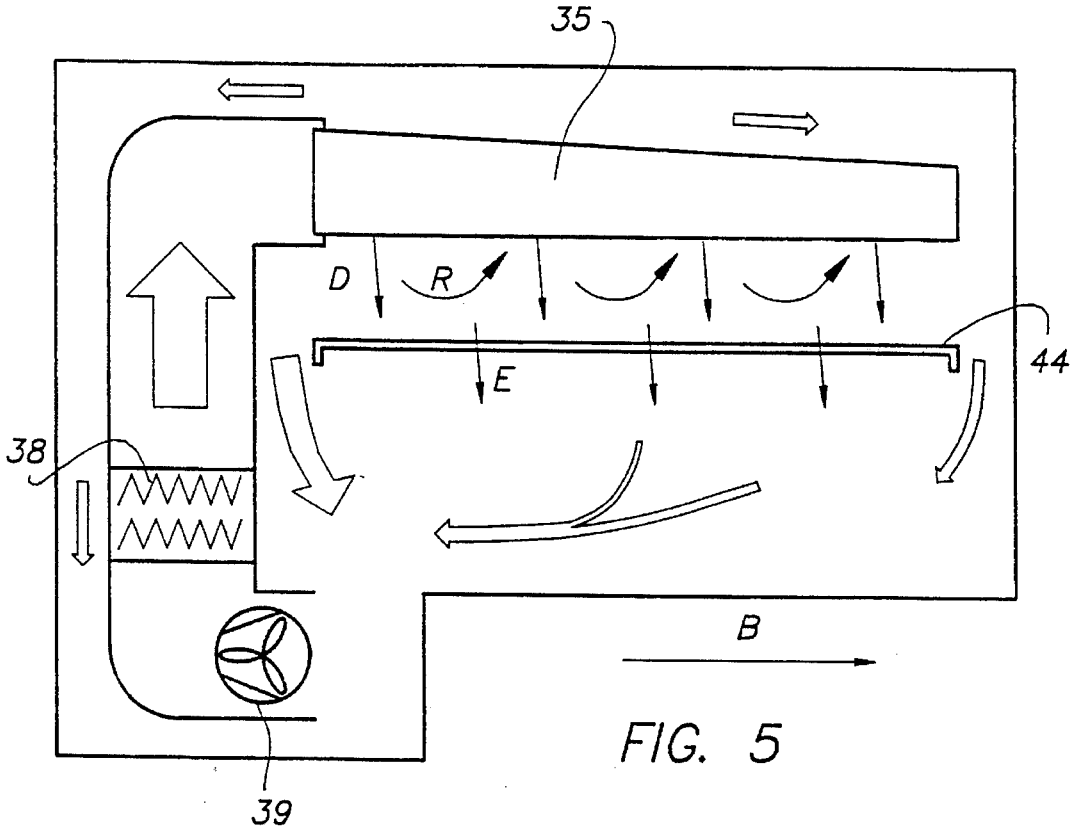
FIG. 5 shows (not to scale) a lateral cross-section through the dryer cassette shown in FIG. 3.

Referring to FIG. 5, it can be seen that the downstream fan 39 is situated on the left hand side of the dryer, as viewed in the transport direction A. As explained above in connection with FIG. 2, a downstream heater 38 is provided for heating air entering the downstream manifold 35. The downstream manifold has a tapered configuration, narrowing in the direction towards the right hand side of the dryer. This tapered construction helps to ensure that the flow of drying air out of the manifold 35, through the blower slots 30 is substantially uniform over the width of the support member 44. As can be seen by the position of the broad arrows in FIG. 5, used drying air returns to the fan 39 either through the openings in the support member 44, over the left hand edge of the support member 44 or over the right hand edge of the support member 44. In particular, the return of used drying air returns to the fan 39 over the left hand edge of the support member 44 as seen in FIG. 5 represents a "short circuit" of the air flow. This uneven return of used drying air has the effect that the air flow distribution across the width of the support member 44 is not uniform, and may even be negative towards the left hand side of the support member with the result that cold air is drawn into the dryer at this side resulting in uneven drying of the photographic material.

Figure 6:
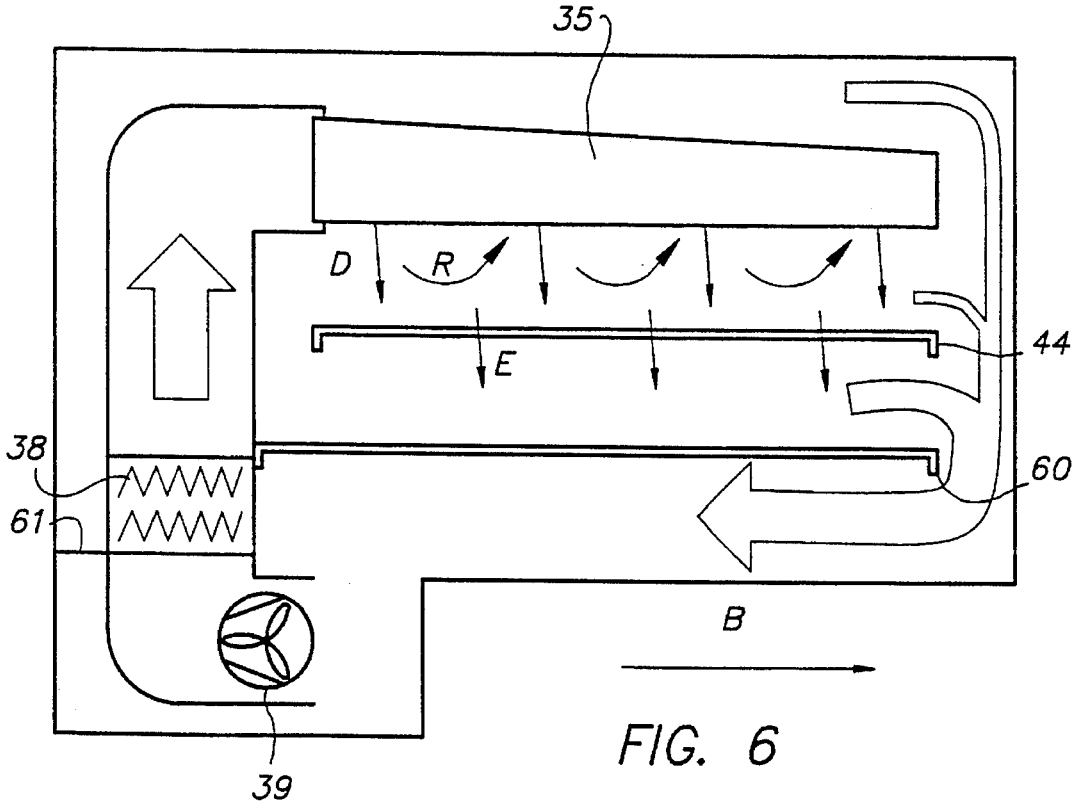
FIG. 6 is a view similar to FIG. 5, of a more preferred embodiment of the invention.

FIG. 6 is a view similar to FIG. 5 of an improved embodiment in which a baffle plate 60 is positioned below the support member 44 and parallel thereto, the baffle plate ensuring that used drying air returns to the fan 39 only at the right hand side of the dryer. This arrangement serves to ensure that the flow of drying air out of the manifold 35, through the blower slots 30 is even more uniform over the width of the support member 44. This more even return of used drying air, again as shown by the broad arrows, and in particular the avoidance of the "short circuit" of the air flow, has the effect that the air flow distribution across the width of the support member 44 is more uniform, with the result that no cold air is drawn into the dryer at the left hand side resulting in more even drying of the photographic material.

In a further preferred embodiment of the present invention, a second baffle plate 61 is positioned at the left side of downstream heater 38 and fan 39, this second baffle plate extra ensures that used drying air does not return to the fan 39 from the left hand side of the dryer.

We claim:

1. An apparatus for the processing of photographic sheet material, the apparatus comprising at least one wet processing station followed by a dryer in which wet sheet material comes into contact with heated drying air, the dryer comprising:

(i) a static support member for supporting the sheet material during the drying thereof;

(ii) feed means for feeding sheet material in a transport direction over said static support member;

(iii) a drying unit positioned opposite to and extending across said static support member in a direction transverse to said transport direction, thereby to define a drying space between said static support member and said drying unit, said drying unit having a drying air exit above the static support member; and (iv) means for feeding drying air to said drying unit to pass out through said drying air exit into said drying space, wherein said static support member includes a plurality of openings to allow drying air to pass therethrough.

2. An apparatus according to claim 1, wherein said openings are in the form of slots.

3. An apparatus according to claim 2, wherein said slots are arranged in a plurality of rows extending transverse to said transport direction.

4. An apparatus according to claim 2, wherein said slots are arranged in a plurality of rows extending at an angle of from 1° to 10° to said transport direction.

5. An apparatus according to claim 1, wherein said static support member has a surface facing said drying unit, said openings occupying from 20% to 40% of the area of said surface.

6. An apparatus according to claim 1, wherein said static support member has a corrugated form defined by a plurality of hollows interspaced with a plurality of ridges, said hollows and ridges extending in a direction transverse to said transport direction.

7. An apparatus according to claim 6, wherein said openings are formed in said hollows.

8. An apparatus according to claim 7, including support means to prevent sheet material from falling into said hollows.

9. An apparatus according to claim 8, wherein said support means comprise a plurality of support wires extending in a direction at an angle of from 5° to 20° to said transport direction.

10. An apparatus according to claim 1, wherein said drying air exit comprises means defining a blower slot, said drying unit further having a return slot positioned adjacent said blower slot through which used drying air is able to leave said drying space.

11. An apparatus according to claim 10, wherein said drying unit comprises a plurality of said blower slots, each said blower slot being defined by upstream and downstream walls.

12. An apparatus according to claim 11, said upstream walls being positioned closer to said static support member than said downstream walls.

13. An apparatus according to claim 1, wherein said feed means comprise a first pair of transport rollers positioned upstream of said static support member and a second pair of transport rollers positioned downstream of said static support member.

14. An apparatus according to claim 1, wherein drying air exit is fed with drying air from a manifold, said manifold being connected at a first side of said dryer to a heater provided for heating air entering said manifold and wherein said manifold has a tapered configuration, narrowing in the direction away from said first side.

15. An apparatus according to claim 14, in which a baffle plate is positioned below said static support member and parallel thereto, the baffle plate ensuring that used drying air returns to said fan from the opposite side of said dryer.

16. A method for drying wet photographic sheet material comprising the steps of:

(a) supporting a sheet material on a static support member, said static support member having a plurality of openings to allow drying air to pass through said static support member, (b) feeding said static support member along a transport direction, thereby feeding said sheet material along the transport direction, (c) conducting said sheet material past a drying unit, wherein said drying unit is positioned opposite to and extending across said static support member in a direction transverse to the transport direction, thereby defining a drying space between said static support member and said drying unit, said drying unit having a drying air exit above said static support member, and (d) drying said sheet material by feeding an amount of heated drying air into said drying unit, wherein the heated drying air passes out of said drying air exit into the drying space and contacts said sheet material, said amount of heated drying air being substantially independent of the size of said sheet material.

17. A method according to claim 16, wherein said amount of heated drying air passes through said drying air exit and contacts said sheet material at an angle substantially normal to said sheet material.

18. A method according to claim 16, wherein said heated drying air is so directed such that external air is substantially excluded from being drawn into the drying space during the step of drying said sheet material.

* * * * *

UNITED STATES PATENT AND TRADEMARK OFFICE

CERTIFICATE OF CORRECTION

PATENT NO. : 5,537,178

DATED : July 16, 1996

INVENTOR(S) : Van Den Bergen et al.

It is certified that error appears in the above-indentified patent and that said Letters Patent is hereby corrected as shown below:

Title page, Item 73, "Aofa-Gevaert" should read --Agfa-Gevaert--;

Column 1, line 61, "static: " should read --static--;

Column 4, line 64, "inn" should read --in--.

Signed and Sealed this

Twenty-ninth Day of October 1996

*Attest:*

Bruce Lehman

BRUCE LEHMAN

*Attesting Officer*

*Commissioner of Patents and Trademarks*